United States Patent [19]

Pruitt

[11] 4,383,577

[45] May 17, 1983

[54] ROTATING HEAD FOR AIR, GAS AND MUD DRILLING

[76] Inventor: Alfred B. Pruitt, 4108 S. 35th St., Fort Smith, Ark. 72903

[21] Appl. No.: 234,447

[22] Filed: Feb. 10, 1981

[51] Int. Cl.[3] ..... E21B 3/02

[52] U.S. Cl. ..... 166/95; 277/31; 308/187; 175/229; 175/195

[58] Field of Search ..... 166/95, 88; 175/195, 175/228, 229; 277/31; 308/76, 122, 170, 187

[56] References Cited

U.S. PATENT DOCUMENTS

| | | | |
|---|---|---|---|
| 1,157,644 | 10/1915 | London | 308/134.1 |
| 3,400,938 | 9/1968 | Williams | 175/214 |
| 3,529,835 | 9/1970 | Lewis | 277/31 |
| 4,037,890 | 7/1977 | Kurita et al. | 308/134.1 X |
| 4,181,185 | 1/1980 | Keller et al. | 175/229 |
| 4,304,310 | 12/1981 | Garrett | 166/84 X |

*Primary Examiner*—Ernest R. Purser
*Assistant Examiner*—Thuy M. Bui
*Attorney, Agent, or Firm*—Dennison, Meserole, Pollack & Scheiner

[57] ABSTRACT

A rotating head assembly having roller thrust bearings rotatably journaling an inner barrel is provided with pump means for continuous forced circulation of lubricating oil to, and around, the thrust bearings during operation. A lubricating oil chamber substantially surrounds the bearings, which chamber is effectively sealed against leakage of oil fluids, and other debris, into the chamber and lubricating oil out of the chamber. The lower end of the rotatably journaled inner barrel is provided with a stripper rubber structured to enable use of the head with drill pipe of diverse outer diameters.

10 Claims, 3 Drawing Figures

ROTATING HEAD FOR AIR, GAS AND MUD DRILLING

BACKGROUND OF THE INVENTION

In well drilling, with a rotary drilling rig, the drill bit and drilling pipe receive rotary motion from power equipment located on the surface. Below the drilling floor, at the ground surface, there is usually an assembly known as a drilling head that provides means for the circulation of various fluids used in the drilling.

U.S. Pat. No. 3,400,938, issued Sept. 10, 1960, discloses a drilling head assembly including means for assisting a circulation of lubricant around thrust bearings and sealing such bearings from well fluids and other debris. The circulation of lubricant around the bearings is assisted by providing annular recesses adjacent the bearings but is such as does not provide forced lubrication of the bearings.

The provision of forced circulation of lubricant for bearings journaling a shaft for rotation about a vertical axis is examplified by U.S. Pat. Nos. 1,157,644, issued Oct. 19, 1915 and 4,037,890, issued July 26, 1977. The former patent is provided with a bushing secured to the shaft for rotation therewith, which bushing has on its exterior surface spiral grooves which feed lubricant upwardly toward the bearing within which the shaft is journaled. The latter patent is directed to utilizing a spiral groove pump, also situated beneath the bearing, to pump lubricating oil downwardly into a lubricant reservoir extending upwardly to a point above the bearing whereby lubricating oil is caused to overflow downwardly into the bearing.

In U.S. Pat. No. 3,061,387, issued Oct. 30, 1962, there is disclosed in conjunction with a bearing for a vertically rotatable shaft the provision of a vertically disposed open ended tube rotatable with the shaft to cause lubricant to be continuously fed from a reservoir adjacent the lower end of the tube to the upper end of the tube whereby lubricant is fed continuously upwardly through the tube and when a critical speed is attained, the lubricant rises sufficiently high in the tube to be fed out from the top end to spray against the lower portion of an upper bearing, which oil then drains downwards toward and through a lower bearing as it returns by gravity to the reservoir.

Present day drilling operations are extremely expensive, and an effort to increase the overall efficiency of the drilling operation while minimizing expense requires the essentially continuous operation of the drilling rig. Thus, it is imperative that downtime be minimized.

In this regard, there is a need for improved sealing, lubricating and cooling of bearings to maximize the useful life of the bearings. Seals for such bearings must effectively preclude the intrusion of well fluids or debris while at the same time insuring retention of the bearing lubricant. To further minimize downtime, it would be highly desirable if the rotating head were capable of cooperating with drill pipe of diverse outer diameter, thereby eliminating the need to shut down to change stripper rubbers.

SUMMARY OF THE INVENTION

This invention relates to oil field equipment and specifically to a rotary drilling head assembly having a stationary outer barrel with an inner barrel rotatably journaled therein and including a stripper rubber carried by the inner barrel for slidably receiving a pipe string in sealed relation thereto. The stripper means is thus journaled for rotation relative to the main body of the head such that the annulus which is formed between the rotatable stripper and the stationary bowl of the head may be provided with a flow connection so that drilling mud can flow up the bore hole annulus and out of the bowl.

Thus, the rotating head of the present invention is actually a diverter in that it comprises a means for diverting drilling fluid returning upwardly from the bore hole from blowing up through the derrick.

In a preferred embodiment of the invention, the stripper rubber is structured so as to cooperate with drill pipe of diverse outer diameter so as to minimize downtime when the drilling operation requires a change of drill pipe size.

A significant aspect of the invention resides in a means for the continuous forced circulation of lubricating oil for the bearings that rotatably journal the inner barrel. The lubricant circulation means is configured so as to enhance the cooling of the bearings whereby essentially round-the-clock operation may be maintained for months at a time without bearing malfunction as would require a shutdown of the drilling operation.

The primary object of this invention is to provide a rotating head for air, gas and mud drilling which has improved sealing and bearing lubrication means.

Another object of this invention is to provide a drilling head that is capable of stripping down over drill pipe of diverse outer diameter.

Still another object of this invention is to provide a rotating head with improved pump means for the forced circulation of bearing lubricating and cooling fluid.

Still another object of this invention is to provide an improved lubricant and cooling fluid pumping means that significantly assists in general uniform cooling of the inner and outer races of thrust bearings rotatably journaling an inner barrel.

A further object of this invention is to provide a novel rotating head particularly suited for air, gas and mud drilling for extended periods of time without necessitating shutdown of the drilling operation.

DETAILED DESCRIPTION OF THE DRAWINGS

Figure 1:
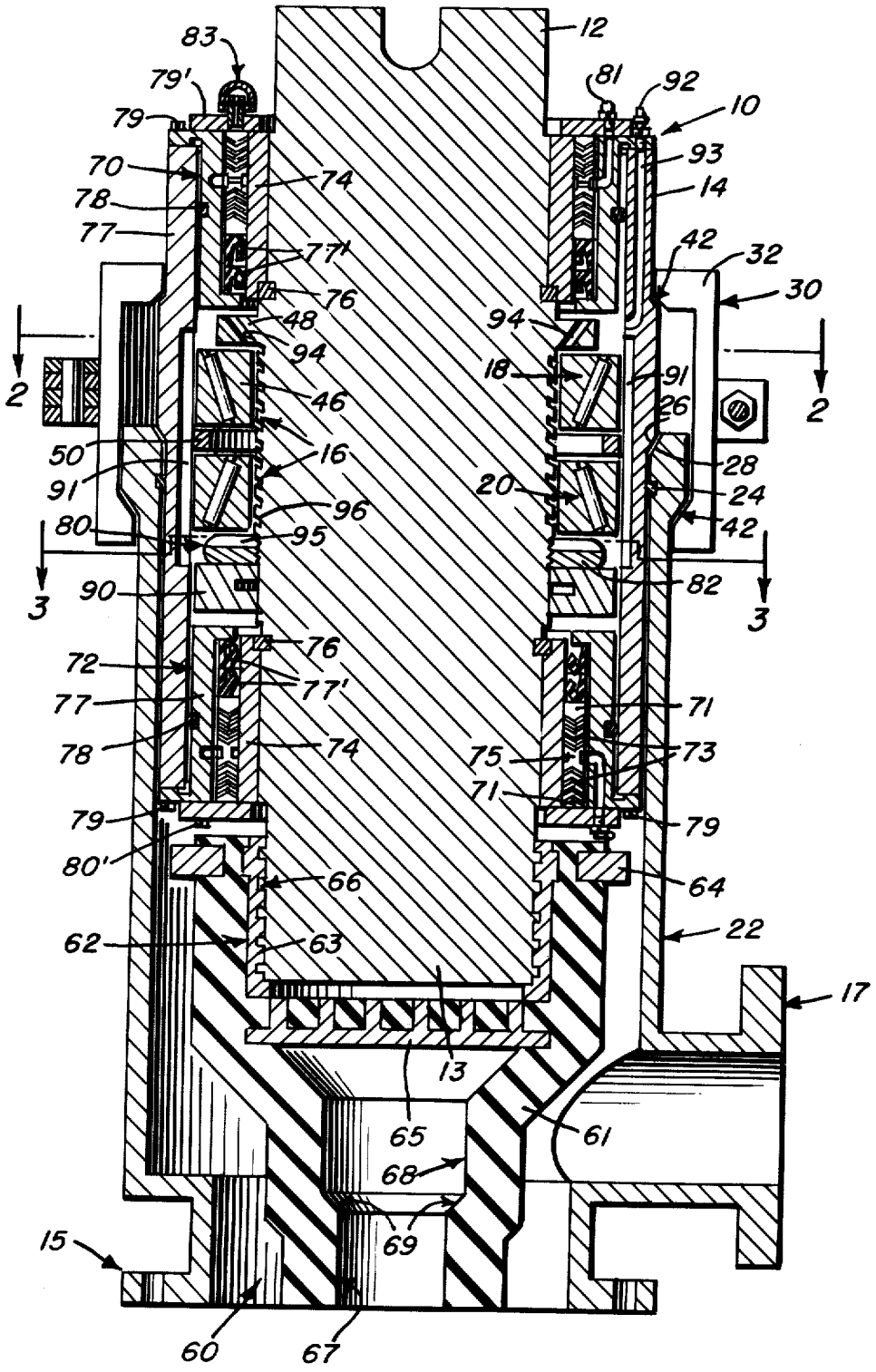
FIG. 1 is a vertical cross section of a rotating drilling head embodying the invention.

Turning now to FIG. 1, a rotating drilling head assembly generally indicated at 10 includes an inner barrel 12 rotatably journaled in a stationary outer barrel 14. For purposes of illustration, the inner barrel 12 is illustrated as being solid but it will be appreciated that in many drilling operations the inner barrel 12 would in fact be tubular. The inner barrel 12 is rotatably journaled in the stationary outer barrel 14 such as by means of one or more antifriction bearing means generally indicated at 16, it being understood that the use of roller thrust bearings is preferred. Since the rotatable inner barrel 12 must be capable of operating for significant periods of time under sizable upwardly directed forces as well as downwardly directed forces, is preferred to use at least two vertically spaced thrust bearing assemblies. In this regard, an upper thrust bearing assembly is generally indicated at 18 and a lower thrust bearing assembly generally indicated at 20. It will be seen that the roller bearing assemblies 18 and 20 are operatively positioned interposed the inner barrel 12 and outer barrel 14 with the inclination of the frustroconical races reversed as between the upper and lower bearing assemblies, thereby tending to more uniformly distribute the forces to which the bearing assemblies 18 and 20 are subjected.

For purposes of illustration, the operatively associated stationary outer barrel 14 and rotatably journaled inner barrel 12 are illustrated as being seated in an air bowl generally indicated at 22 in sealed relation thereto by means of a side seal rubber 24 and wherein the outer barrel 14 is provided with an annular shoulder 26 that seats against a complementary annular shoulder 28 of the air bowl 22. The outer barrel 14 is locked and maintained in fixed relation to the air bowl 22 by locking ring means generally indicated at 30 including, as seen best in FIG. 2, encompassing bands 32 and 34 hinged as generally indicated at 36 and secured in locking or clamping relation as generally indicated at 38, such as by use of a nut and bolt fastener 40. The locking ring means 30 is of generally conventional structure and wherein as best seen in FIG. 1, each locking ring band 32 and 34 includes inwardly directed annular rim portions provided with frustroconical annular shoulders that coact with complementary shoulders provided on the air bowl 22 and stationary outer barrel 14 such as generally indicated at 42. The air bowl 22 and locking ring means are illustrated merely to provide a showing of the operative placement of the stationary barrel-rotatable barrel assembly 14–12 of the present invention and wherein the air bowl 22 is provided with conventional flange-bolt coupling means generally indicated at 15 for operative connection to a complementary flange of a bore hole casing, not shown. The air bowl 22 is provided with a flanged outflow pipe generally indicated at 17 that enables conducting fluid flow from the bore hole annulus, not shown, to a remote location such as a mud recovery pit.

Fluid, such as drilling mud, flowing upwardly in the bore hole annulus, is diverted outwardly through the flanged pipe 17 by virtue of the fact that an elastomeric stripper means generally indicated at 60, hereinafter called a "stripper rubber" is removably fixed to the lower end 13 of the inner barrel 12 by means to be discussed in greater detail. In addition, as generally indicated at 70 and 72, means are provided for packing the upper and lower ends of the stationary outer barrel 14 relative to the rotatably journaled inner barrel 12. The unique arrangement of seals and packing members comprising the packing means 70 and 72 will be described in greater detail hereinbelow. For the present, it will suffice to state that the packing means 70 and 72 preclude the entry of bore hole fluid or debris into the annulus defined between the packing means 70 and 72 and the outer diameter of the inner barrel 12 and inner diameter of the outer barrel 14.

As seen in FIG. 1, the upper and lower thrust bearing assemblies 18 and 20 respectively are operatively positioned within the region packed off by the packing means 70 and 72.

A significant aspect of the present invention resides in the fact that the aforedescribed region intermediate the packing means 70 and 72 comprises a lubricating oil chamber indicated generally at 80 that comprises a portion of a means for continuous forced circulation of oil to lubricate and cool the upper and lower thrust bearing assemblies 18 and 20.

From a consideration of the relative diameter of the "steps" of the stepped inner barrel 12, it will be seen that the assembly of the components carried by the inner barrel may, for example, be accomplished as follows. The upper roller thrust bearing assembly 18 is mounted on the inner barrel 12 with the inner race 46 resting against a radially outwardly projecting ring 48 integral with the barrel 12. The assembly of the upper packing means 70 is commenced by press fitting a chrome plated packing sleeve 74 on the inner barrel 12, which sleeve 74 is keyed thereto by keystock as indicated at 76. The inner barrel 12 with the upper thrust bearing assembly 18 and packing sleeve 74 thereon may then be inserted into the inner bore of the outer barrel 14 with the outer race 47 of the upper thrust bearing assembly 18 resting against the upper thrust bearing assembly 18 resting against the upper surface of a spacer ring 50 placed within the inner bore of the outer barrel 14. It will be appreciated that the spacer "ring" 50 may in some instances be an integral part of the outer barrel 14.

The lower thrust bearing assembly 20 is then seated on the inner barrel 12, it being appreciated that at this point the inner and outer races of the thrust bearing assemblies 18 and 20 are now seated on the adjacent surfaces of inner and outer barrels 12 and 14, respectively. A lubricating oil pump impeller 82 is then threadably engaged on the inner barrel and suitably torqued. A thrust nut 90 is threadably engaged on the inner barrel and suitably tightened to complete the preloading of the upper and lower thrust bearing assemblies 18 and 20, respectively.

As with the upper packing means 70, assembly of the lower packing means 72 is initiated by press fitting a chrome packing sleeve 74 onto the lower end 13 of the inner barrel 12, which packing ring 74 is keyed at 76 in a manner similar to the packing rings 74 of the upper packing means 70.

The assembly of the remaining components of the upper and lower packing means 70 and 72 is then carried out and wherein upper and lower packing box members 77 having O rings 78 seated in an annular groove are inserted into the upper and lower ends of the outer barrel 14 and bolted thereto by a plurality of bolts 79, one of which is illustrated in connection with the packing box 77 at the upper end of the outer barrel 14, and two of which are shown in connection with the bolting of the packing box 77 relative to the lower end of the outer barrel 14. It will be appreciated that there is provided a plurality of such bolts on a common bolt circle for securement of the packing boxes 77 relative to the outer barrel 14.

The packing means 70 and 72 are then "packed" in an identical manner to form a seal between the inner barrel 12 and outer barrel 14. In this regard, two annular elastomeric seals 77', preferably of a "J" cross-section are sequentially introduced into the annulus between the sleeve 74 and the packing box 77 with the interior of the "J" facing inwardly as will ensure that the pressure exerted by fluid contained within the interior of the rotating head will urge the seals into a sealing engagement with the packing sleeve 74 and packing box 77. Suitable "J" seals comprise Viton seals, a trademark for such seals manufactured by Chicago Rawhide Company. The upper and lower packing means 70 and 72 are each then provided with chevron packing means comprising upper and lower backup rings 71 having positioned therebetween in symmetrical relation complementary upwardly and downwardly "pointing" chevron packing 73 with a packing box lantern ring 75 interposed therebetween. As best seen in conjunction with the illustration of upper packing means 70, packing retainer plate 79' is secured by a circle of bolts 80', at least one of which can be seen in conjunction with securement of the packing retainer plate 79 relative to the packing box 77 of the lower packing means 72. In addition, as best seen in conjunction with the illustration of the upper packing means 70, an annular groove is provided in communication with the inner bore of the packing box 77, which groove communicates with a grease fitting, e.g., a Zerk fitting 81', threadably received in a bore passing through the packing retainer plate 79 which grease fitting is on the aforedescribed bolt circle with respect to the bolts fastening the retainer plate to the packing box 77. Further, as also seen in conjunction with the upper packing means 70, a breather means indicated generally at 83 communicates the interior of the upper packing box means 70 with the ambient. It will be understood that while the lower packing means 72 is provided with a Zerk fitting, i.e., a fitting having a spring loaded check therein, as is required to introduce and retain grease in lubricating and sealing enhancing relation to the chevron packings, the lower packing means 72 must not be provided with a breather, since to do so would communicate the packing in the lower means 72 with bore hole fluid as would thus seriously compromise the effectiveness of the lower packing means 72.

Returning now to the stripper rubber 60, it will be understood that it is molded of elastomeric material and that in the preferred embodiment illustrated the elastomeric body 61 of the stripper means 60 is preferably molded to a supporting and mounting ring member 62 such as is machined from stainless steel or other suitably corrosion resistant alloy. The mounting ring 62 comprises integrally connected threaded mounting sleeve portion 63 outwardly projecting mounting flange 64 and internal pressure resisting plate portion 65, as will be appreciated from the hatching as seen in FIG. 1.

The stripper rubber 60 is removably secured to the lower end 13 of the inner barrel 12 by complementary threads as generally indicated at 66, and wherein in the exemplary embodiment illustrated, the inner barrel 12 is provided with male threads and the supporting and mounting ring 62 provided with female threads. In addition, although not illustrated, it will be understood that the stripper rubber 60 is removably fixed relative to the inner barrel 12 by means of a set screw, or the like, or set screws received in suitably threaded bores in the ring portion 64. In this regard, it is to be understood that the ring portion 64 is a generally continuous flange having apertures therethrough for flow of elastomeric material therethrough so as to provide the mechanical engagement of the body 61 of the stripper 60 with a ring 64. Similarly, the elastomeric material of which the stripper 60 is formed, is also mechanically interlocked with the pressure plate portion 65 of the supporting and mounting ring 62. As generally indicated at 67 and 68, the body 61 of the stripper 60 is molded so as to be capable of "stripping down" over drill pipe of two diverse outer diameters, e.g., diameter 67 being sized so as to cooperate with drill pipe having a 3½ inch outer diameter and diameter 68 being sized so as to cooperate with drill piping having a 4½ inch outer diameter.

From the foregoing description of the stripper rubber 60, it will be appreciated that significant downtime may be saved by the provision of a plurality of effective diameters. It will be understood, of course, that during utilization of the stripper rubber 60 with the surface defining the diameter 68 sealingly engaged about a drill pipe having a 4½ inch outer diameter that the body 61 of the stripper rubber 60 will deform, or bend, outwardly as generally indicated at 69. It will be understood that the portion of the body 61 of the stripper rubber 60 depending downwardly from the point of flexure generally indicated at 69 must be less than would occlude the annulus between such portion and the connector flange means 15, since occlusion of such annulus would impede or possibly valve off the outward flow of bore hole fluid through the pipe means 17.

Figure 2:
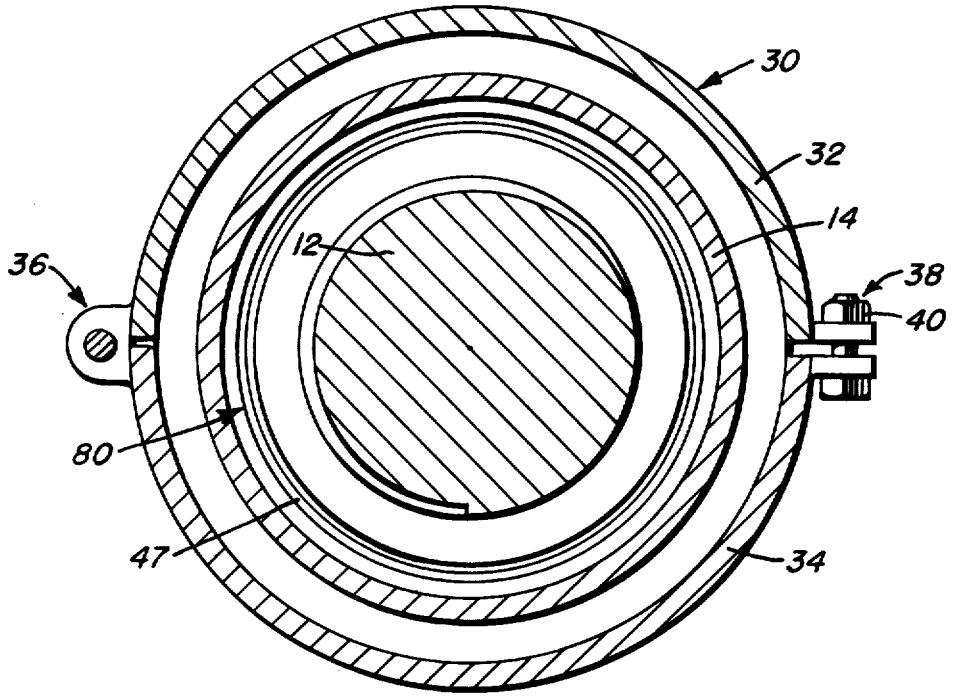
FIG. 2 is a horizontal sectional view generally taken on line 2—2 of FIG. 1 and wherein a cross section through the entire rotating head is illustrated.
Figure 3:
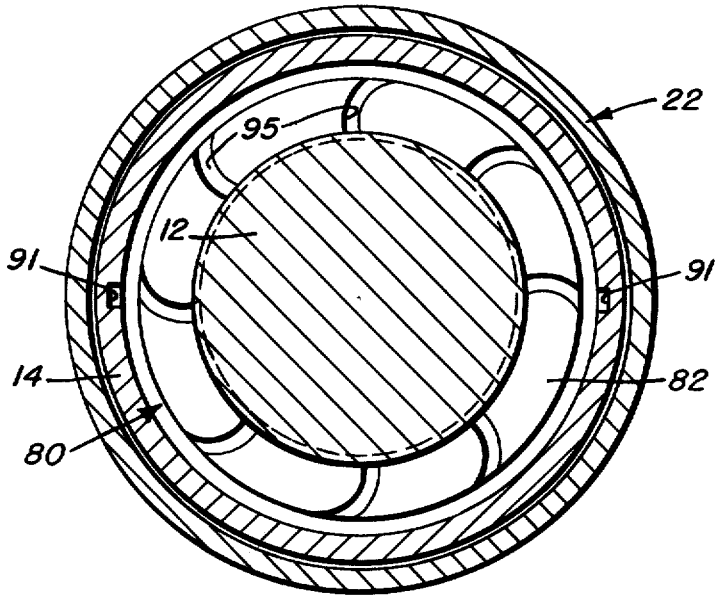
FIG. 3 is a horizontal cross sectional view generally taken on line 3—3 of FIG. 1 and wherein the view has been expanded to include a sectional view of the entire diameter of the rotating head and wherein certain details of a lubricating and cooling fluid pump means are illustrated.

The ability of the rotating drilling head 10 of the present invention to withstand the rigors of essentially continuous service for months at a time is to a large degree dependent on the means for forced circulation of oil to lubricate, and equally importantly, cool the upper and lower thrust bearing assemblies 18 and 20. In this regard, the means for forced circulation of lubricating and cooling oil comprises elements associated with both the rotatable inner barrel 12 and the stationary outer barrel 14. As briefly touched upon previously, the lubricating and cooling oil chamber is comprised of the interstitial void formed between the inner barrel 12, upper and lower thrust bearing means 18 and 20, pump impeller 82, thrust nut 90, upper and lower packing means 70 and 72, and finally stationary outer barrel 14. In addition, as seen in FIGS. 1, 2 and 3, the stationary outer barrel 14 is provided with longitudinally extending grooves the extent of which is preferably from at least the region of ring 48 to the lower surface of pump impeller 82. While two such grooves 91 are illustrated, which grooves are 180° apart, it will be appreciated that the number of grooves 91 or the circumferential extent of such grooves may be varied, and that such grooves may extend longitudinally further than illustrated as long as the longitudinal extent of such grooves does not extend past the O rings 78.

To ensure continuous circulation of lubricating and cooling oil, the chamber 80 is not normally completely flooded. In practice it has been found best to fill the chamber 80 to approximately a point intermediate the upper and lower thrust bearing assemblies 18 and 20. For drilling conditions generally encountered in the southern tier of the continental United States, it has been found that appropriate lubricating and cooling oil comprises SAE 90 swivel oil. The detailed description of the means for circulating the lubricating and cooling oil will be discussed in conjunction with "start-up" and then continuous run. In the former regard, oil is introduced into the chamber 80 to a level intermediate the thrust bearing assemblies 18 and 20 by means of a channel 93, machined or otherwise formed, in the outer barrel 14 which oil filled channel 93 is in communication in its lower end with the upper portion of the chamber 80 and at its upper end terminates in a quick couple fitting 92 for facilitating introduction of the oil.

Thus, as best seen from a simultaneous consideration of FIGS. 1 and 3, the oil initially sumped in the lower portion of the chamber 80 upon startup, i.e., rotation of the inner barrel 12 in a clockwise direction causes the arcuate impeller, or pickup grooves 95, to subject the oil to the first of a two stage pump means whereby the oil is urged centripetally inwardly, whereupon the oil is subjected to a second pumping stage by virtue of a spiral groove such as comprising a one inch lead, ⅛ inch right hand spiral groove 96, that "pumps" the oil upwardly along the inner surface of the inner races of the upper and lower thrust bearing means 18 and 20. The oil then flows upwardly and outwardly through a plurality of discharge channels 94 whereupon the oil is distributed over the upper surface of the upper bearing means 18 and downwardly therethrough, whereupon it cascades downwardly through the lower bearing means 20, as seen best in FIG. 1, and graphically illustrated by the flow arrows, oil in excess of that which can flow downwardly through the bearings is returned to the sump region of the chamber 80 by means of the longitudinally extending grooves. A highly significant aspect of the present invention resides in the heat exchange relationship of the spiral groove or grooves 96 relative to the inner races of the bearing assemblies 18 and 20. It has been found that the aforedescribed two-stage means for ensuring continuous forced circulation of lubricating and cooling oil greatly enhances the continuous troublefree operation of the drilling head 10 over extended periods of time. Thus, in summary, the first stage impeller means 82 ensures that the pickup or lead end of the spiral grooves of the inner barrel 12 are constantly flooded whereby in continuous operation the inner races of the upper and lower bearing means 18 and 20 are maintained at a generally uniform temperature. The bearings are maintained in an essentially lubricant flooded condition and the recycle of lubricant through the longitudinally extending grooves in the outer barrel 14 enables conductive and radiant dissipation of heat from the lubricating and cooling oil to the ambient.

What is claimed is:

1. A drilling head for a well bore comprising a stationary bowl, a rotatable head assembly removably fixed in sealed engagement with said bowl, said rotatable head assembly comprising a rotatable barrel, a stationary barrel surrounding the rotatable barrel, a longitudinally extending chamber provided between the stationary and rotatable barrels for receiving lubricating and cooling fluid, bearing means having inner and outer races interposed between the stationary and rotatable barrels and disposed within the chamber, upper and lower packing means generally carried by the stationary barrel and providing a seal for the chamber to substantially preclude leakage of fluid into or out of the chamber and means generally disposed within said chamber for forced circulation of lubricating and cooling fluid upwardly between said inner race and said rotatable barrel and downwardly between said outer race and said stationary barrel and through said bearing means said means for forced circulation of lubricating and cooling fluid being effected by pump means operated by said rotatable barrel.

2. The drilling head as set forth in claim 1 wherein said chamber includes a void provided by grooves in said stationary barrel.

3. The drilling head as set forth in claim 1 wherein said pump means comprises two stage pump means including impeller means carried by said rotatable barrel and helical groove means integral with said rotatable barrel.

4. The drilling head as set forth in claim 3 wherein said helical groove means is in heat exchange relationship with said bearing means.

5. The drilling head as set forth in claim 3 including said rotatable barrel having stripper means removably secured thereto.

6. The drilling head of claim 5 wherein said stripper means includes a body portion adapted to coact with drill pipe of diverse outer diameter.

7. The drilling head of claim 5 wherein said means for forced circulation of lubricating and cooling fluid is affected by pump means operated by said rotatable barrel.

8. The drilling head of claim 7 wherein said pump means comprises two stage pump means including impeller means carried by said rotatable barrel and helical groove means integral with said rotatable barrel.

9. The drilling head as set forth in claim 8 wherein said helical groove means is in heat exchange relationship with said bearing means.

10. A drilling head for a well bore comprising a stationary bowl, a rotatable head assembly removably fixed in sealed engagement with said bowl, said rotatable head assembly comprising a rotatable barrel, a stationary barrel surrounding the rotatable barrel, a longitudinally extending chamber provided between the stationary and rotatable barrels for receiving lubricating and cooling fluid, bearing means interposed between the stationary and rotatable barrels and disposed within the chamber, upper and lower packing means generally carried by the stationary barrel and providing a seal for the chamber to substantially preclude leakage of fluid into or out of the chamber and means generally disposed within said chamber for forced circulation of lubricating and cooling fluid around and through said bearing means, said means for forced circulation of lubricating and cooling fluid being effected by pump means operated by said rotatable barrel, said pump means comprising two stage pump means including impeller means carried by said rotatable barrel and helical groove means integral with said rotatable barrel.

* * * * *